US011746473B2

(12) United States Patent
Shannon et al.

(10) Patent No.: US 11,746,473 B2
(45) Date of Patent: Sep. 5, 2023

(54) LAYERED TISSUE COMPRISING LONG, HIGH-COARSENESS WOOD PULP FIBERS

(71) Applicant: Kimberly-Clark Worldwide, Inc., Neenah, WI (US)

(72) Inventors: Thomas Gerard Shannon, Neenah, WI (US); Stephen Michael Lindsay, Appleton, WI (US); Brent Merrik Thompson, Oshkosh, WI (US); Richard Louis Underhill, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/829,812

(22) Filed: Jun. 1, 2022

(65) Prior Publication Data

US 2022/0290378 A1 Sep. 15, 2022

Related U.S. Application Data

(62) Division of application No. 17/284,606, filed as application No. PCT/US2019/014174 on Jan. 18, 2019, now Pat. No. 11,384,484.

(51) Int. Cl.

| | |
|---|---|
| ***D21H 27/38*** | (2006.01) |
| ***D21H 11/04*** | (2006.01) |
| ***D21H 27/00*** | (2006.01) |
| ***D21F 11/14*** | (2006.01) |

(52) U.S. Cl.
CPC ..... *D21H 27/38* (2013.01); *D21F 11/14* (2013.01); *D21H 11/04* (2013.01); *D21H 27/002* (2013.01)

(58) Field of Classification Search
USPC ..... 162/125
See application file for complete search history.

(56) References Cited

U.S. PATENT DOCUMENTS

| | | | |
|---|---|---|---|
| 5,147,505 | A | 9/1992 | Altman |
| 5,538,595 | A | 7/1996 | Trokhan et al. |
| 5,562,805 | A | 10/1996 | Kamps et al. |
| 6,153,053 | A | 11/2000 | Harper et al. |
| 6,231,721 | B1 | 5/2001 | Quick et al. |
| 6,638,884 | B2 | 10/2003 | Quick et al. |
| 6,719,862 | B2 | 4/2004 | Quick et al. |
| 7,497,925 | B2 | 3/2009 | Hermans et al. |
| 7,785,698 | B2 | 8/2010 | Prodoehl |
| 7,935,409 | B2 | 5/2011 | Burazin et al. |
| 8,741,104 | B2 | 6/2014 | Edwards et al. |
| 9,458,570 | B2 | 10/2016 | Jabar, Jr. et al. |
| 2003/0056916 | A1 | 3/2003 | Horenziak et al. |
| 2004/0192136 | A1 | 9/2004 | Gusky et al. |
| 2005/0252626 | A1 | 11/2005 | Chen et al. |
| 2007/0137807 | A1 | 6/2007 | Schulz et al. |
| 2007/0224419 | A1 | 9/2007 | Sumnicht et al. |
| 2008/0014428 | A1 | 1/2008 | Vinson et al. |
| 2010/0032113 | A1 | 2/2010 | Awofeso et al. |
| 2010/0065234 | A1 | 3/2010 | Klerelid et al. |
| 2010/0065237 | A1 | 3/2010 | Trochlil |
| 2013/0029106 | A1 | 1/2013 | Lee et al. |
| 2013/0071655 | A1 | 3/2013 | Zwick et al. |
| 2014/0050890 | A1 | 2/2014 | Zwick et al. |
| 2014/0096924 | A1 | 4/2014 | Rekoske et al. |
| 2014/0150339 | A1 | 6/2014 | Underhill et al. |
| 2014/0284010 | A1 | 9/2014 | Shannon |
| 2016/0145809 | A1 | 5/2016 | Hermans et al. |
| 2016/0145810 | A1 | 5/2016 | Miller, IV et al. |
| 2016/0244916 | A1 | 8/2016 | Neogi et al. |
| 2016/0319488 | A1 | 11/2016 | Hermans et al. |
| 2016/0355987 | A1 | 12/2016 | Hermans et al. |
| 2016/0362843 | A1 | 12/2016 | Hermans et al. |
| 2017/0204568 | A1 | 7/2017 | Timm et al. |
| 2017/0284029 | A1 | 10/2017 | Hermans et al. |
| 2017/0328011 | A1 | 11/2017 | Sealey, II et al. |
| 2018/0030654 | A1 | 2/2018 | Chute |
| 2018/0334778 | A1 | 11/2018 | Shannon et al. |

FOREIGN PATENT DOCUMENTS

| | | | |
|---|---|---|---|
| CN | 103764904 | A | 4/2014 |
| CN | 103814173 | A | 5/2014 |
| CN | 105113315 | A | 12/2015 |
| WO | 08068651 | A2 | 6/2008 |
| WO | 09156888 | A2 | 12/2009 |

OTHER PUBLICATIONS

Watson, Paul et al., "High quality NBSK fibre for premium tissue paper grades", Tissue World Magazine, http://www.tissueworldmagazine.com/featured-slider/high-quality-nbsk-fibre-for-premium-tissue-paper-grades/.

*Primary Examiner* — Mark Halpern
(74) *Attorney, Agent, or Firm* — Kimberly-Clark Worldwide, Inc.

(57) ABSTRACT

The present invention provides mufti-layered tissue webs, and tissue product comprising the same, comprising long, high-coarseness wood pulp fibers selectively deposited in one or more outer layers of the multi-layered web. Surprisingly disposing long, high-coarseness wood pulp fibers in one or more outer layers, even in relatively modest amounts, may improve certain product properties, such as durability, without negatively affecting softness. In certain instances, both the softness and durability may be improved by selectively incorporating long, high-coarseness wood pulp fibers in one or more of the outer layers.

13 Claims, No Drawings

LAYERED TISSUE COMPRISING LONG, HIGH-COARSENESS WOOD PULP FIBERS

RELATED APPLICATIONS

The present application is a divisional application and claims priority to U.S. patent application Ser. No. 17/284,606, filed on Apr. 12, 2021, which is a national-phase entry, under 35 U.S.C. § 371, of PCT Patent Application No. PCT/US19/14174, filed on Jan. 18, 2019, all of which are incorporated herein by reference.

BACKGROUND OF THE DISCLOSURE

Papermakers, and in particular tissue paper makers, have long sought to balance the strength and softness of paper products by treating or altering the papermaking furnish. For example, one common practice in the manufacture of tissue products is to provide two furnishes (or sources) of wood pulp fiber. Sometimes, a two-furnish system is used in which the first furnish comprises a wood pulp fiber having a relatively short fiber length, such as a hardwood kraft pulp fiber, and the second furnish is made of wood pulp fiber having a relatively long fiber length, such as softwood kraft pulp fiber. The short fiber furnish may be used to provide the finished product with a softer handfeel, while the long fiber furnish may be used to provide the finished product with strength.

While surface softness in tissue products is an important attribute, a second element in the overall softness is stiffness. Stiffness can be measured from the tensile slope of stress-strain tensile curve. The lower the slope the lower the stiffness and the better overall softness the product will display. Stiffness and tensile strength are positively correlated, however at a given tensile strength shorter fibers Will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low-coarseness long fibers, such as those provided by northern softwood kraft (NSWK) fibers typically supply the best combination of durability and softness in tissue products when those fibers are used in combination with hardwood Kraft fibers such as eucalyptus hardwood kraft fibers. While northern softwood kraft fibers have a higher coarseness than eucalyptus fibers their small cell wall thickness relative to lumen diameter combined with their long length makes them the ideal candidate for optimizing durability and softness in tissue.

Unfortunately, supply of NSWK is under significant pressure both economically and environmentally. As such, prices of NSWK fibers have escalated significantly creating a need to find alternatives to optimize softness and strength in tissue products. Another type of softwood fiber is southern softwood kraft (SSWK) widely used in fluff pulp containing absorbent products such as diapers, feminine care absorbent products and incontinence products. Unfortunately while not under the same supply and environmental pressures as NSWK, fibers from SSWK have widely been considered unsuitable for making soft tissue products because of their relatively high coarseness. The high coarseness results from the SSWK fibers having a wide a cell wall and narrow lumen, which reduce fiber flexibility and often result in stiffer, harsher feeling products compared to those produced with NSWK.

As such, a need currently exists for a tissue product formed from a fiber that will improve durability without negatively affecting other important product properties, such as softness.

SUMMARY OF THE DISCLOSURE

It has now been surprisingly discovered that the short, low-coarseness fiber fraction of the tissue making furnish may be substituted with long wood pulp fibers and more specifically high-coarseness long wood pulp fibers having an average fiber length, which used herein refers to the length weighted average fiber length, greater than about 2.2 mm and a coarseness of 20 mg/100 m or greater, without negatively affecting important tissue properties such as durability or softness. In some instances tissue product properties may actually be improved by substituting short, low-coarseness wood pulp fiber with long, high-coarseness wood pulp. For example, in one embodiment, the present invention provides a soft and durable tissue comprising from about 5 to about 20 weight percent (wt %) long, high-coarseness wood pulp fiber and having a durability index greater than about 3.5 and a TS7 value less than about 11.0 dB $V^2$ rms. Surprisingly, the foregoing properties are comparable or better than those observed in similarly manufactured tissue products consisting essentially of short, low-coarseness wood pulp fibers and long, low-coarseness wood pulp fibers.

In other embodiments the present invention provides a multi-layered tissue web comprising a fabric contacting fibrous layer and a non-fabric contacting, also referred to as the air-side layer, fibrous layer, wherein the fabric contacting fibrous layer comprises wood pulp fibers and the non-fabric contacting fibrous layer comprises a blend of long, high-coarseness wood pulp fibers and short, low-coarseness wood pulp fibers. Preferably the fabric contacting layer is substantially free of long, high-coarseness wood pulp fibers and the tissue web comprises from about 5 to about 20 wt % long, high-coarseness wood pulp fibers. In a particularly preferred embodiment the fabric contacting fibrous layer comprises northern softwood kraft fibers and the non-fabric contacting fibrous layer comprises southern softwood kraft fibers and hardwood kraft fibers.

In yet other embodiments the present invention provides a multi-layered tissue web comprising a fabric contacting fibrous layer and a non-fabric contacting fibrous layer, wherein the fabric contacting fibrous layer consists essentially of wood pulp fibers and is substantially free of long, high-coarseness wood pulp fibers and the non-fabric contacting fibrous layer comprises from about 5 to about 20 wt % long, high-coarseness wood pulp, the tissue web having a composite durability of about 25 or greater and a TS7 of about 11.0 dB $V^2$ rms or less.

In other embodiments the present invention provides a tissue product comprising at least one multi-layered tissue web having first and second outer layers and a middle layer disposed there-between, the web comprising from about 5 to about 20 wt % long, high-coarseness wood pulp having an average fiber length from about 2.2 to about 2.7 mm and a coarseness of 22 mg/100 m or more, such as from 20 to about 26 mg/100 m, the product having a composite durability of about 25 or greater and a TS7 of about 11.0 dB $V^2$ rms or less.

In still other embodiments the present invention provides a multi-layered tissue product comprising a blend of southern softwood kraft fibers and hardwood kraft pulp fibers selectively incorporated into the skin contacting layer of a multi-layered product, such as one or more outer layers of a three-layered tissue product. In particularly preferred embodiments the foregoing tissue product may comprise less than about 15 wt % long, low-coarseness wood pulp fiber yet have improved product properties, such as increased durability and softness.

In still other embodiments the present invention provides a method of forming a tissue web comprising the steps of dispersing a short, low-coarseness wood pulp fiber and long, high-coarseness wood pulp in water to form a first fiber slurry, dispersing a long, low-coarseness wood pulp fiber in water to form a second fiber slurry, depositing the second fiber slurry onto a forming fabric, depositing the first fiber slurry adjacent to the second fiber slurry to form a wet web, dewatering the wet web to a consistency from about 20 to about 30 percent, and drying the wet web to a consistency of greater than about 90 percent thereby forming a dry tissue web, the dry tissue web comprising from about 5 to about 20 wt % long, high-coarseness fiber.

In yet other embodiments the present invention provides a method of forming a tissue web comprising the steps of dispersing hardwood kraft pulp and southern softwood kraft fibers derived from species within the *Pinus* subgenus, and combinations thereof, in water to form a first fiber slurry, dispersing northern softwood kraft pulp in water to form a second fiber slurry, depositing the second fiber slurry onto a forming fabric, depositing the first fiber slurry adjacent to the second fiber slurry to form a wet web, dewatering the wet web to a consistency from about 20 to about 30 percent, and drying the wet web to a consistency of greater than about 90 percent thereby forming a dry tissue web, the dry tissue web comprising from about 5 to about 20 wt % long, high-coarseness wood pulp fibers and having a durability index greater than a similarly manufactured tissue web substantially free from long, high-coarseness fibers. In certain embodiments the first fiber slurry is not subject to refining and the second fiber slurry is refined. In still other embodiments the resulting tissue web may be converted to a tissue product having a TS7 value less than a similarly manufactured tissue web substantially free from long, high-coarseness fibers.

Definitions

As used herein, the term "Fiber" means an elongated particulate having an apparent length greatly exceeding its apparent width. More specifically, and as used herein, fiber means such fibers suitable for a papermaking process and more particularly the tissue paper making process.

As used herein, the term "Cellulosic Fiber" means a fiber composed of or derived from cellulose.

As used herein, the term "Average Fiber Length" means the length weighted average fiber length (LWAFL) of fibers determined utilizing OpTest Fiber Quality Analyzer, model FQA-360 (OpTest Equipment, Inc., Hawkesbury, ON). According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard OpTest Fiber Quality Analyzer fiber analysis test procedure. The length weighted average fiber length may be expressed by the following equation:

$$\text{Length weighted average fiber length} = \frac{\sum_i n_i l_i^2}{\sum_i n_i l_i}$$

Fibers are grouped into various length classes and $n_i$ is the number of fibers in the length class $l_i$.

As used herein, the term "Long" when referring to a cellulosic fiber, such as a wood pulp fiber, generally refers to a fiber having an average fiber length of 1.2 mm or greater, and more preferably greater than about 1.5 mm and still more preferably greater than about 1.8 mm, such as from 1.2 to about 3.0 mm and more preferably from about 1.5 to about 2.5 mm.

As used herein, the term "Short" when referring to a cellulosic fiber, such as a wood pulp fiber, generally refers to a fiber having an average fiber length less than 1.2 mm, such as from about 0.4 to about 1.0 mm, such as from about 0.5 to about 0.75 mm, and more preferably from about 0.6 to about 0.7 mm. One example of short cellulosic fibers useful in the present invention are hardwood pulp fibers, which may be derived from hardwoods selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore and Beech.

As used herein, the term "Coarseness" means the fiber mass per unit of unweighted fiber length reported in units of milligrams per one hundred meters of unweighted fiber length (mg/100 m) as measured using a suitable fiber coarseness measuring device such as the above OpTest Fiber Quality Analyzer. The coarseness of the pulp is an average of three coarseness measurements of three fiber specimens taken from the pulp. The operation of the analyzer for measuring coarseness is similar to the operation for measuring fiber length described above.

As used herein, the term "Low-coarseness" when referring to a cellulosic fiber, such as a wood pulp fiber, generally refers to a fiber having a coarseness less than 20 mg/100 m and more preferably 18 mg/100 m or less and still more preferably 15 mg/100 m. Exemplary low-coarseness fibers include kraft pulp fibers derived from lodgepole pine (*Pinus contorta*), Jack pine (*Pinus banksiana*), and/or white spruce (*Picea engelmannii, Picea glauca*, etc.).

As used herein, the term "High-coarseness" when referring to a cellulosic fiber, such as a wood pulp fiber, generally refers to a fiber having a coarseness of 20 mg/100 m or greater, such as about 21 mg/100 m or greater, such as about 22 mg/100 m or greater, such as from 20 to about 26 mg/100 m.

As used herein, the term "Tissue Product" means products made from tissue webs and includes, bath tissues, facial tissues, paper towels, industrial wipers, foodservice wipers, napkins, medical pads, and other similar products.

As used herein, the term "Tissue Web" means a fibrous sheet material suitable for use as a tissue product.

As used herein, the term "Ply" means a discrete product element. Individual plies may be arranged in juxtaposition to each other. The term may refer to a plurality of web-like components such as in a multi-ply facial tissue, bath tissue, paper towel, wipe, or napkin.

As used herein, the term "Layer" means a plurality of strata of fibers, chemical treatments, or the like, within a ply.

As used herein, the terms "Layered," "Multi-Layered," and the like, refer to fibrous sheets prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein, the term "Substantially Free" when used in reference to a given layer of a multi-layered fibrous web means the given layer comprises less than about 0.25 wt % of the subject fiber, by weight of the layer. The foregoing amounts of fiber are generally considered negligible and do not affect the physical properties of the layer. Moreover the presence of negligible amounts of subject fibers in a given layer generally arise from fibers disposed in an adjacent layer, and have not been purposefully disposed in a given layer. For example where a given layer of a multi-layered tissue web is said to be substantially free of long, low-coarseness wood pulp fibers, the given layer generally comprises less than about 0.25 percent long, low-coarseness wood pulp fiber, by weight of the layer.

As used herein, the term "Basis Weight" means the bone dry weight per unit area of a tissue and is generally expressed as grams per square meter (gsm). Basis weight is measured using TAPPI test method T-220. While basis weight may be varied, tissue products prepared according to the present invention and comprising one, two or three plies, generally have a basis weight greater than about 30 gsm, such as from about 30 to about 60 gsm and more preferably from about 35 to about 45 gsm.

As used herein, the term "Caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa). The caliper of a tissue product may vary depending on a variety of manufacturing processes and the number of plies in the product, however, tissue products prepared according to the present invention generally have a caliper greater than about 500 μm, more preferably greater than about 575 μm and still more preferably greater than about 600 μm, such as from about 500 to about 800 μm and more preferably from about 600 to about 750 μm.

As used herein, the term "Sheet Bulk" refers to the quotient of the caliper (generally having units of μm) divided by the bone dry basis weight (generally having units of gsm). The resulting sheet bulk is expressed in cubic centimeters per gram (cc/g). Through-air dried tissue products prepared according to the present invention generally have a sheet bulk greater than about 8 cc/g, more preferably greater than about 10 cc/g and still more preferably greater than about 12 cc/g, such as from about 8 to about 20 cc/g and more preferably from about 12 to about 18 cc/g. Creped wet pressed tissue products prepared according to the present invention generally have a sheet bulk greater than about 7 cc/g, more preferably greater than about 9 cc/g, such as from about 7 to about 10 cc/g.

As used herein, the term "Geometric Mean Tensile" (GMT) refers to the square root of the product of the machine direction tensile strength and the cross-machine direction tensile strength of the tissue product. While the GMT may vary, tissue products prepared according to the present invention generally have a GMT greater than about 500 g/3", more preferably greater than about 600 g/3" and still more preferably greater than about 800 g/3", such as from about 500 to about 1,500 g/3", such as from about 700 to about 1,200 g/3".

As used herein, the term "Slope" refers to the slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g) or kilograms (kg).

As used herein, the term "Geometric Mean Slope" (GM Slope) refers to the square root of the product of machine direction slope and cross-machine direction slope. GM Slope generally is expressed in units of kilograms (kg). While the GM Slope may vary, tissue products prepared according to the present invention generally have a GM Slope less than about 10.0 kg, more preferably less than about 8.0 kg and still more preferably less than about 6.0 kg.

As used herein, the term "Stiffness Index" refers to GM Slope (having units of kg), divided by GMT (having units of g/3") multiplied by 1,000. While the Stiffness Index may vary, tissue products prepared according to the present invention generally have a Stiffness Index less than about 10.0 and more preferably less than about 8.0, such as from about 6.0 to about 10.0.

As used herein, the term "Geometric Mean Tensile Energy Absorption" (GM TEA) refers to the square root of the product MD TEA and CD TEA, which are measured in the course of determining tensile strength as described below. GM TEA has units of $gm*cm/cm^2$.

As used herein, the term "Composite Durability" refers to the sum of GM Tear, GM TEA and Wet Burst divided by 10. Composite Durability is reported without reference to units. While the Composite Durability may vary depending on the composition of the tissue web or product in certain instances tissue products of the present invention may have a composite durability of about 25.0 or greater, such as about 30.0 or greater, such as about 34.0 or greater.

As used herein, the term "Durability Index" refers to the sum of a product's Wet Burst Index (Wet Burst divided by the GMT of the product, multiplied by 10), GM TEA Index (GM TEA divided by GMT, multiplied by 100) and GM Tear Index (GM Tear divided by GMT, multiplied by 100) and is an indication of the durability of the product at a given tensile strength. Durability Index is reported without reference to units. While the Durability Index may vary depending on the composition of the tissue web or product in certain instances tissue products of the present invention may have a Durability Index of about 3.75 or greater, such as about 4.0 or greater, such as about 4.25 or greater.

As used herein, the terms "TS7" and "TS7 value" refer to the output of the EMTEC Tissue Softness Analyzer (commercially available from Emtec Electronic GmbH, Leipzig, Germany) as described in the Test Methods section. TS7 has units of dB $V^2$ rms, however, TS7 may be referred to herein without reference to units. The TS7 value is the frequency peak that occurs around 6.5 kHz on the noise spectrum graph output from the EMTEC Tissue Softness Analyzer. This peak represents the softness of the sample. Generally, softer samples produce a lower TS7 peak. In certain embodiments the invention provides a tissue product, such as a through-air dried tissue product, having a TS7 less than about 12.0 and more preferably less than about 11.0, and still more preferably less than about 10.0.

As used herein, "weight percent," "percent by weight" (wt %) in reference to a named compound or material means the amount of the respective named compound or material, exclusive, for example, of any associated solvent, relative to a mixture or composition that contains the compound or material, expressed as a percent of the total weight of such mixture or composition.

DETAILED DESCRIPTION OF THE DISCLOSURE

The present invention provides multi-layered tissue webs, and tissue product comprising the same, comprising long, high-coarseness wood pulp fibers selectively deposited in one or more outer layers of the multi-layered web. Surprisingly disposing long, high-coarseness wood pulp fibers in one or more outer layers, even in relatively modest amounts; may improve certain product properties, such as durability, without negatively affecting softness. In certain instances, both the softness and durability may be improved by selectively incorporating long, high-coarseness wood pulp fibers in one or more of the outer layers.

Thus, in certain embodiments the present invention relates to tissue products, and more particularly multi-ply through-air dried tissue products, comprising long, high-coarseness fibers, such as conventional southern softwood kraft pulp (SSWK) fibers selectively disposed in at least one layer and comprising from about 5.0 to about 20 weight percent (wt %) of the product, in certain instances the long, high-coarseness fibers may be blended with short, low-coarseness fibers, such as hardwood kraft pulp fibers, and the other layers may be substantially free from long, high-coarseness fibers. In certain instances the long, high-coarseness fibers may replace a portion of the long, low-coarseness fiber, such as northern softwood kraft (NSWK), conventionally used to manufacture consumer preferred soft and durable tissue products.

Surprisingly the amount of long, low-coarseness fiber in a given product may be reduced by adding long, high-coarseness fiber to an outer layer of the product without significantly impairing important tissue physical properties such as durability and softness. For example, in certain embodiments the inventive tissue products comprise from about 5.0 to about 20 wt % long, high-coarseness fiber, such as conventional SSWK, and less than about 30 wt % NSWK, yet have improved durability and softness relative to a comparable tissue product comprising more than 30 wt % NSWK and substantially tree from SSWK. The ability to replace a portion of the NSWK with SSWK and to dispose the softwood fibers in different layers, while maintaining or improving tissue product properties is surprising provided that SSWK has traditionally been unsuitable for use in manufacturing premium tissue products because of its high-coarseness, particularly relative to NSWK, as shown in Table 1, below.

TABLE 1

| Fiber Type | Average Fiber Length (mm) | Coarseness (mg/100 m) | Avg. Fiber Length: Coarseness |
|---|---|---|---|
| Conventional SSWK | 2.45 | 24.67 | 0.099 |
| Conventional NSWK | 2.25 | 14.8 | 0.152 |
| Eucalyptus kraft pulp | 0.76 | 8.95 | 0.085 |

While SSWK fibers are higher in coarseness compared to NSWK fibers they may replace NSWK fibers in tissue products without impairing important physical properties such as durability, strength and softness. Accordingly, in certain embodiments the tissue products of the present invention comprise long, high-coarseness fibers in an outer layer and have increased softness (measured as TS7) and improved durability (measured as Composite Durability or Durability Index), compared to similar tissue products that are substantially free from long, high-coarseness fibers.

Tissue webs and products of the present invention generally comprise at least about 5.0 weight percent (wt %) long, high-coarseness fiber and more preferably at least about 10 wt %, such as from about 5.0 to about 20 percent wt %. In a particularly preferred embodiments the inventive tissue products comprise from about 5 to about 10 wt % long, high-coarseness fiber where the fiber is selectively incorporated into only one layer of a multi-layered web.

Long, high-coarseness wood pulp fibers useful in the present invention are generally derived from the *Pinus* subgenus. Suitable species within the *Pinus* subgenus include, for example, *P. taeda, P. elliotti, P. palustris, P. pungens, P. rigida, P. serotina, P. muricata* and *P. radiata*. Particularly preferred are *P. taeda, P. elliotti*, and *P. palustris*. Preferably the long, high-coarseness wood pulp fibers have an average fiber length greater than 1.2 mm, more preferably greater than about 1.3 mm and still more preferably greater than about 1.4 mm, such as an average fiber length from about 1.0 to about 3.0 mm and more preferably from about 1.2 to about 2.8 mm. In certain embodiments the long, high-coarseness wood pulp fibers may be derived from two or more different species and may have different fiber lengths.

Further, the long, high-coarseness wood pulp fibers generally have a coarseness of 20 mg/100 m or greater, such as about 21 mg/100 m or greater, such as about 22 mg/100 m or greater, such as from 20 to about 26 mg/100 m. In addition to having relatively high coarseness, such as 20 mg/100 m or greater, long, high-coarseness wood pulp fibers useful in the present invention may have a relatively low ratio of average fiber length to coarseness, such as about 0.15 or less, such as about 0.12 or less, such as from about 0.09 to about 0.15, such as from about 0.09 to about 0.12.

One example of long, high-coarseness fiber useful in the present invention are southern softwood kraft pulp (SSWK) fibers, which may be derived the from *Pinus* subgenus. Suitable species within the *Pinus* subgenus include, for example, *P. taeda, P. elliotti, P. palustris, P. pungens, P. rigida, P. serotina, P. muricata* and *P. radiata*. Particularly preferred are *P. taeda, P. elliotti*, and *P. palustris*. Further, it is to be understood that the compositions disclosed herein are not limited to containing any one species of long, high-coarseness southern softwood fiber and may comprise a blend of long, high-coarseness southern softwood fibers derived from two or more species, such as a blend of fibers derived from *P. taeda, P. elliotti*, and *P. palustris*.

Tissue webs and products made in accordance with the present invention are formed from a stratified fiber furnish producing layers within the web or product. Stratified base webs can be formed using equipment known in the art, such as a multi-layered headbox. For example, stratified base webs may be manufactured as described in U.S. Pat. Nos. 4,225,382, 5,164,045 and 5,494,554, the contents of which are incorporated herein in a manner consistent with the present disclosure. Generally as used herein, a stratified or layered web is a single fibrous web made up of plural layers with distinct properties. While a small degree of mixing between strata at their interfaces is inevitable, such mixing is desirably held to a minimum in accordance with the present invention.

In one embodiment the tissue product may comprise one or more two-layered tissue webs. The two-layered tissue webs may comprise an air contacting layer and a fabric contacting layer. The long, high-coarseness fibers may be selectively incorporated into the air contacting layer such that the long, high-coarseness fibers comprise from 5 to about 20 wt % of the product. The fabric contacting layer may comprise long, low-coarseness fibers, such as NSWK, and may be substantially free from the long, high-coarseness fibers.

In other embodiments the tissue products may be prepared from one or more multi-layered tissue webs having three or more layers, such as a first outer layer, a middle layer and a second outer layer. Generally at least one of the outer layers, and in certain instances both of the outer layers, comprise long, high-coarseness fibers, such as conventional SWSK. The middle layer, which is generally positioned between, and in certain instances immediately adjacent to, the first and second outer layers may comprise long, low-coarseness wood pulp fibers, such as NSWK fibers. In particularly preferred embodiments the middle layer is substantially free from long, high-coarseness fiber. Regardless of whether the long, high-coarseness fiber is incorporated into one or both outer layers, the product generally comprises from about 5 to about 20 wt % long, high-coarseness fiber.

In a particularly preferred embodiment the tissue product may comprise a three-layered web where the first and second outer layers consist essentially of long, high-coarseness fibers, such as conventional SSWK, and short cellulosic fibers, such as hardwood pulp fibers. The outer layers may comprise from about 40 to about 70 wt % of the product. The middle layer, which is generally positioned immediately adjacent to the first and second outer layers, may comprise long, low-coarseness wood pulp fibers, such as NSWK fibers. Preferably the middle layer is substantially free from long, high-coarseness fibers. In certain instances the middle layer may comprise from about 30 to about 60 wt % of the product.

Webs prepared as described herein may be converted into either single- or multi-ply tissue products, where one or more of the plies may be formed by a multi-layered tissue web having long, high-coarseness fiber selectively incorporated in one of its layers. In one embodiment the tissue product is constructed such that the long, high-coarseness fibers are brought into contact with the user's skin in-use. For example, the tissue product may comprise two multi-layered webs wherein each web comprises a fabric contacting layer substantially free from long, high-coarseness fiber and an air contacting layer comprising long, high-coarseness. The webs are plied together such that the outer surface of the tissue product is formed from the air contacting layers of each web, such that the surface brought into contact with the user's skin in-use comprises long, high-coarseness fiber.

The foregoing tissue webs may be manufactured by dispersing short, low-coarseness fiber, such as hardwood kraft fiber, and long, high-coarseness fiber, such as conventional SSWK, in water to form a first fiber slurry, dispersing a long, low-coarseness wood pulp fiber, such as NSWK, in water to form a second fiber slurry, depositing the second fiber slurry onto a forming fabric, depositing the first fiber slurry adjacent to the second fiber slurry to form a wet web, dewatering the wet web to a consistency from about 20 to about 30 percent, and drying the wet web to a consistency of greater than about 90 percent thereby forming a dry tissue web, the dry tissue web comprising from about 5 to about 20 wt % long, high-coarseness fiber. In a particularly preferred embodiment the first fiber slurry is not refined, that is neither the short, low-coarseness wood pulp fiber nor the long, high-coarseness wood pulp fibers are refined. The second fiber slurry may optionally be refined to modify the strength of the resulting tissue web.

Tissue webs of the present invention can generally be formed by any of a variety of papermaking processes known in the art. Preferably the tissue web is formed by through-air drying and may be either creped or uncreped. For example, a papermaking process of the present invention can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present invention. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From the forming fabric, a formed web is transferred to a second fabric, which may be either a wire or a felt. The fabric is supported for movement around a continuous path by a plurality of guide rolls. A pick up roll designed to facilitate transfer of the web from fabric to fabric may be included to transfer the web.

In the creped through-air dried process the formed web is dried by transfer to the surface of a rotatable heated dryer drum, such as a Yankee dryer. The web may be transferred to the Yankee dryer directly from the through-air drying fabric or, preferably, transferred to an impression fabric which is then used to transfer the web to the Yankee dryer. In accordance with the present invention, the creping composition of the present invention may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In other embodiments, the base web is formed by an uncreped through-air drying process such as those described, for example, in U.S. Pat. Nos. 5,656,132 and 6,017,417, both of which are hereby incorporated by reference herein in a manner consistent with the present invention. The uncreped through-air drying process may comprise a twin wire former having a papermaking headbox which injects or deposits a furnish of an aqueous suspension of wood fibers onto a plurality of forming fabrics, such as an outer forming fabric and an inner forming fabric, thereby forming a wet tissue web. The forming process may be any conventional forming process known in the papermaking industry. Such formation processes include, but are not limited to, Fourdriniers, roof formers such as suction breast roll formers, and gap formers such as twin wire formers and crescent formers.

The basis weight of tissue webs made in accordance with the present disclosure can vary depending upon the final product. For example, the process may be used to produce bath tissues, facial tissues, paper towels, and the like. In general, the basis weight of the tissue web may vary from about 5 to about 80 grams per square meter (gsm), such as from about 10 to about 60 gsm. Tissue webs may be converted into single and multi-ply bath or facial tissue products having a basis weight from about 10 to about 80 gsm and more preferably from about 20 to about 50 gsm.

The tissue webs and products of the present invention are preferably strong enough to withstand use, yet of sufficiently low strength so as not to adversely affect softness. For example, tissue products may have a GMT from about 500 to about 2,000 g/3", such as from about 500 to about 1,500 g/3" and more preferably from about 500 to about 1,200 g/3" and still more preferably from about 700 to about 1,200 g/3". Single ply products may have a GMT from about 700 to about 1,000 g/3". Multi-ply products may have a GMT from about 800 to 1,500 g/3".

In other instances the tissue webs and products of the present invention have relatively low stiffness, such as a Stiffness Index less than about 10, such as less than about 9.0, such as less than about 8.0, such as from about 5.0 to about 8.0. In certain instances the tissue product may be a single-ply rolled bath tissue product having a GMT from about 700 to about 1,000 g/3" and a Stiffness Index from about 5.5 to about 7.5.

In addition to having sufficient strength to withstand use and relatively low stiffness, the tissue webs and products of the present disclosure also have good bulk characteristics, regardless of the method of manufacture. For instance, through-air dried tissue products prepared using long, high-coarseness fibers may have a sheet bulk greater than about 10 cc/g, such as greater than about 12 cc/g, such as greater than about 14 cc/g, such as from about 10 to about 18 cc/g. In a particularly preferred embodiment the invention provides a through-air dried bath tissue product, and more preferably uncreped through-air dried bath tissue product, comprising long, high-coarseness fibers having a sheet bulk from about 14 to about 18 cc/g.

In still other instances tissue products of the present invention, which may be a single-ply or multi-ply tissue product, exhibit GM Tear strength of about 10.0 gf or greater, such as about 11.0 gf or greater, such as about 12.0 gf or greater, such as 13.0 gf or greater, such as from about 10.0 to about 15.0 gf. In other instances the tissue products of the present invention exhibit GM TEA of about 5.0 g*cm/cm$^2$ or greater, such as about 6.0 g*cm/cm$^2$ or greater, such as about 7.0 g*cm/cm$^2$ or greater, such as 8.0 g*cm/cm$^2$ or greater, such as from about 5.0 to about 10.0 g*cm/cm$^2$.

In still other instances tissue webs and products of the present invention exhibit a Wet Burst of about 100 gf or greater, such as about 105 gf or greater, such as about 110 gf or greater, such as about 120 gf or greater, such as from about 100 to about 150 gf. In a particularly preferred embodiment the invention provides a single-ply through-air dried bath tissue product, and more preferably an uncreped through-air dried bath tissue product, comprising long, high-coarseness fibers having a Wet Burst of about 100 gf or greater.

In still other instances the invention provides tissue products having both good durability (measured as Durability Index) and softness (measured as TS7). For example, tissue products may have a Durability Index of about 22 or greater, such as greater than about 25, such as greater than about 30, and a TS7 less than about 13 dB V$^2$ rms, such as less than about 12 dB V$^2$ rms, such as less than about 11 dB V$^2$ rms, such as from about 10 to about 13 dB V$^2$ rms. The foregoing TS7 values may be achieved at geometric mean tensile strengths from about 500 to about 1,500 g/3". In one embodiment the invention provides a through-air dried bath tissue product having a GMT from about 700 to about 1,500 g/3", a Durability Index of about 22 or greater, and a TS7 less than about 11 dB V$^2$ rms.

Test Methods

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Wet Burst

Wet Burst Strength is measured using an EJA Burst Tester (series #50360, commercially available from Thwing-Albert Instrument Company, Philadelphia, Pa.). The test procedure is according to TAPPI T570 pm-00 except the test speed. The test specimen is clamped between two concentric rings whose inner diameter defines the circular area under test. A penetration assembly, the top of which is a smooth, spherical steel ball, is arranged perpendicular to and centered under the rings holding the test specimen. The penetration assembly is raised at 6 inches per minute such that the steel ball contacts and eventually penetrates the test specimen to the point of specimen rupture. The maximum force applied by the penetration assembly at the instant of specimen rupture is reported as the burst strength in grams force (gf) of the specimen.

The penetration assembly consists of a spherical penetration member which is a stainless steel ball with a diameter of 0.625±0.002 inches (15.88±0.05 mm) finished spherical to 0.00004 inches (0.001 mm). The spherical penetration member is permanently affixed to the end of a 0.375±0.010 inch (9.525±0.254 mm) solid steel rod. A 2000 gram load cell is used and 50 percent of the load range i.e. 0-1000 g is selected. The distance of travel of the probe is such that the upper most surface of the spherical ball reaches a distance of 1.375 inches (34.9 mm) above the plane of the sample clamped in the test. A means to secure the test specimen for testing consisting of upper and lower concentric rings of approximately 0.25 inches (6.4 mm) thick aluminum between which the sample is firmly held by pneumatic clamps operated under a filtered air source at 60 psi. The clamping rings are 3.50±0.01 inches (88.9±0.3 mm) in internal diameter and approximately 6.5 inches (165 mm) in outside diameter. The clamping surfaces of the clamping rings are coated with a commercial grade of neoprene approximately 0.0625 inches (1.6 mm) thick having a Shore hardness of 70-85 (A scale). The neoprene needs not cover the entire surface of the clamping ring but is coincident with the inner diameter, thus having an inner diameter of 3.50±0.01 inches (88.9±0.3 mm) and is 0.5 inches (12.7 mm) wide, thus having an external diameter of 4.5±0.01 inches (114±0.3 mm). For each test a total of 3 sheets of product are combined.

The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Samples are conditioned under TAPPI conditions and cut into 127×127 ±5 mm squares. Samples are then wetted for testing with 0.5 mL of deionized water dispensed with an automated pipette. The wet sample is tested immediately after insulting.

The peak load (gf) and energy to peak (g-cm) are recorded and the process repeated for all remaining specimens. A minimum of five specimens are tested per sample and the peak load average of five tests is reported.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue base sheet such that the test specimen measures 63±0.15 mm (2.5±0.006 inches) in the direction to be tested (such as the MD or CD direction) and between 73 and 114 mm (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For base sheets intended to be multiple ply products, the tear results are reported as the tear of the multiple ply product and not the single ply base sheet. This is done by multiplying the single ply base sheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inches (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A base sheet intended to be used for a 2-ply product was tested as two plies and the tensile recorded as such. Alternatively, a single ply may be tested and the result multiplied by the number of plies in the final product to get the tensile strength.

Tissue Softness

Tissue softness was measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 values the blades are pressed against the sample with a load of 100 mN and the rotational speed of the blades is two revolutions per second.

The frequency analysis in the range of approximately 200 to 1000 Hz represents the surface smoothness or texture of the test piece. The peak in the frequency range between 200 to 1000 Hz is herein referred to as the TS750 value and is expressed as dB $V^2$ rms. A high amplitude peak correlates to a rougher surface.

A further peak in the frequency range between 6 and 7 kHz represents the softness of the test piece. The peak in the frequency range between 6 and 7 kHz is herein referred to as the TS7 value and is expressed as dB $V^2$ rms. The lower the amplitude of the peak occurring between 6 and 7 kHz, the softer the test piece.

In addition to TS750 and TS7, the analyzer reports a stiffness parameter (D) having units of mm/N. The stiffness parameter (D) is the deformation of the sample under a defined load.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (air contacting side in the case of uncreped samples or the dryer or Yankee contacting side in the case of creped samples) side of the sample facing upward. The sample is secured and the measurements are started via the PC. The PC records, processes and stores all of the data according to standard TSA protocol. The reported values are the average of five replicates, each one with a new sample.

EXAMPLES

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Initially, northern softwood kraft (NSWK) pulp was dispersed in a pulper for 30 minutes at 4 percent consistency at about 100° F. The NSWK pulp was then transferred to a dump chest and subsequently diluted to approximately 3 percent consistency. In certain instances the NSWK pulp was refined as indicated in Table 3, below, to control the strength of the finished product. The NSWK pulp was added to the middle side layer of the 3-layer tissue structure.

Eucalyptus hardwood kraft (EHWK) pulp was dispersed in a pulper for 30 minutes at about 4 percent consistency at about 100° F. The EHWK pulp was then transferred to a dump chest and subsequently diluted to about 3 percent consistency. The EHWK pulp was not refined. The EHWK pulp was added to the two outer most layers of the 3-layer tissue structure.

The conventional southern softwood kraft pulp (SSWK) had the following properties:

TABLE 2

| | Average Fiber Length (mm) | Coarseness (mg/100 m) | LWFL: Coarseness |
|---|---|---|---|
| Conventional SSWK | 2.45 | 24.67 | 0.099 |

SSWK pulp was dispersed in a pulper for 30 minutes at 4 percent consistency at about 100° F. The SSWK pulp was then transferred to a dump chest and subsequently diluted to approximately 3 percent consistency. The SSWK pulp was not refined. SSWK pulp was added either to the middle or outer layers of the of the 3-layer tissue structure, as indicated in Table 3, below.

In all instances a cationic strength agent, marketed under the trade name FennoBond™ 3000 (Kemira Chemicals Inc., Atlanta, Ga.), was added at 2 kg per metric tonne of furnish to the center layer prior to formation of the web. A chemical debonder (ProSoft™, Solenis, Wilmington, Del.) was added at 4 kg per metric tonne of furnish to the outer layers.

The pulp fibers from the machine chests were pumped to the headbox at a consistency of about 0.1 percent. Pulp fibers from each machine chest were sent through separate manifolds in the headbox to create a three-layered tissue structure. The specific furnish layer splits are set forth in Table 3.

TABLE 3

| Sample | Middle Layer | | Outer Layers | | Refining (hp-day/MT) |
|---|---|---|---|---|---|
| Inventive 1-1 | NSWK (30%) | — | EHWK (60%) | SSWK (10%) | — |
| Inventive 1-2 | NSWK (30%) | — | EHWK (60%) | SSWK (10%) | 0.7 |
| Inventive 1-3 | NSWK (30%) | — | EHWK (60%) | SSWK (10%) | 1.5 |
| Control 1-1 | NSWK (20%) | SSWK (20%) | EHWK (60%) | — | — |
| Control 1-2 | NSWK (20%) | SSWK (20%) | EHWK (60%) | — | 0.7 |
| Control 1-3 | NSWK (20%) | SSWK (20%) | EHWK (60%) | — | 1.5 |
| Control 2-1 | NSWK (40%) | — | EHWK (60%) | — | — |
| Control 2-2 | NSWK (40%) | — | EHWK (60%) | — | 0.7 |
| Control 2-3 | NSWK (40%) | — | EHWK (60%) | — | 1.5 |

The tissue web was formed on a forming fabric, vacuum dewatered to approximately 25 percent consistency and then subjected to rush transfer when transferred to the transfer fabric. The web was then transferred to a through-air drying fabric. Transfer to the through-drying fabric was done using vacuum levels of greater than 10 inches of mercury at the transfer and a rush transfer rate of about 28 percent. The web was then through-air dried to approximately 98 percent solids before winding.

The base sheet webs were converted into rolled bath products by calendering using a conventional polyurethane/steel calender comprising a 4 P&J polyurethane roll on the air side of the sheet and a standard steel roll on the fabric side. The finished product comprised a single ply of base sheet. The finished products were subjected to physical testing, the results of which are summarized in Tables 4 and 5, below.

TABLE 4

| Sample | Basis Weight (gsm) | Sheet Bulk (cc/g) | GMT (g/3") | GM Slope (kg) | GM Tear (gf) | GM TEA (g * cm/cm$^2$) | Wet Burst (gf) |
|---|---|---|---|---|---|---|---|
| Inventive 1-1 | 37.6 | 12.6 | 563 | 4.81 | 9.38 | 5.49 | 96 |
| Inventive 1-2 | 38.5 | 15.4 | 755 | 5.27 | 11.15 | 7.40 | 104 |
| Inventive 1-3 | 39.9 | 13.4 | 885 | 5.12 | 13.02 | 8.68 | 115 |
| Control 1-1 | 39.5 | 12.8 | 566 | 4.88 | 8.99 | 5.74 | 107 |
| Control 1-2 | 39.0 | 13.3 | 668 | 4.77 | 10.59 | 6.92 | 126 |
| Control 1-3 | 37.7 | 14.6 | 879 | 5.32 | 13.96 | 8.67 | 147 |
| Control 2-1 | 39.1 | 13.7 | 685 | 4.98 | 9.92 | 6.86 | 102 |
| Control 2-2 | 37.3 | 15.1 | 820 | 4.97 | 12.67 | 7.78 | 116 |
| Control 2-3 | 37.8 | 13.2 | 908 | 5.43 | 13.13 | 8.63 | 128 |

TABLE 5

| Sample | Stiffness Index | Composite Durability | Durability Index | TS7 | TS750 |
|---|---|---|---|---|---|
| Inventive 1-1 | 8.55 | 24.5 | 4.35 | 10.56 | 54.9 |
| Inventive 1-2 | 6.98 | 29.0 | 3.84 | 11.72 | 77.4 |
| Inventive 1-3 | 5.78 | 33.2 | 3.75 | 13.08 | 86.5 |
| Control 1-1 | 8.63 | 25.4 | 4.49 | 10.65 | 57.0 |
| Control 1-2 | 7.14 | 30.1 | 4.50 | 11.27 | 67.0 |
| Control 1-3 | 6.05 | 37.3 | 4.24 | 13.59 | 80.2 |
| Control 2-1 | 7.27 | 27.0 | 3.94 | 10.67 | 65.7 |
| Control 2-2 | 6.07 | 32.0 | 3.91 | 11.56 | 73.9 |
| Control 2-3 | 5.98 | 34.5 | 3.81 | 11.99 | 78.3 |

EMBODIMENTS

First embodiment: A tissue product comprising at least one multi-layered tissue web having a first and a second outer layer and a middle layer disposed there between, wherein the first and the second outer layers comprise from about 5 to about 20 weight percent (wt %) long, high-coarseness fiber having an average fiber length greater than about 2.0 mm and a coarseness of 20 mg/100 m or greater, the tissue product having a geometric mean tensile (GMT) from about 700 to about 1,200 g/3" and a TS7 value less than about 12.0 dB V$^2$ rms.

Second embodiment: The tissue product of the first embodiment wherein the center layer is substantially free from long, high-coarseness fiber.

Third embodiment: The tissue product of the first or the second embodiments wherein the long, high-coarseness fiber is derived from *P. taeda, P. elliotti, P. palustris, P. pungens, P. rigida, P. serotina, P. muricata*, or *P. radiata*, and combinations thereof.

Fourth embodiment: The tissue product of any one of the first through third embodiments wherein the long, high-coarseness fiber has an average fiber length from about 2.0 to about 3.0 mm.

Fifth embodiment: The tissue product of the any one of the first through fourth embodiments having a GMT from about 700 to about 1,000 g/3" and a stiffness index from about 5.0 to about 8.0.

Sixth embodiment: The tissue product of the any one of the first through fifth embodiments having a GMT from about 700 to about 1,000 g/3" and a durability index greater than about 3.75.

Seventh embodiment: The tissue product of the any one of the first through sixth embodiments having a GM Tear from about 10.0 to about 15.0 gf.

Eighth embodiment: The tissue product of the any one of the first through seventh embodiments having a GM TEA from about 9.0 to about 13.0 g*cm/cm2.

Ninth embodiment: The tissue product of the any one of the first through eighth embodiments having Wet Burst of about 100 gf or greater.

Tenth embodiment: The tissue product of the any one of the first through ninth embodiments wherein the tissue product comprises from about 50 to about 70 wt % short, low-coarseness fiber.

Eleventh embodiment: The tissue product of the any one of the first through tenth embodiments wherein the long, high-coarseness fiber has a ratio of average fiber length, having units of mm, to coarseness, having units of mg/100 m, of about 0.12 or less, such as from about 0.09 to about 0.12.

Twelfth embodiment: The tissue product of the any one of the first through eleventh embodiments having a TS7 value from about 10.0 to about 12.0 dB V$^2$ rms.

Thirteenth embodiment: The tissue product of the any one of the first through twelfth embodiments wherein the tissue product comprises 1, 2 or 3 multi-layered tissue webs and each of the multi-layered tissue are substantially identical.

Fourteenth embodiment: The tissue product of the any one of the first through thirteenth embodiments wherein the multi-layered tissue web is a creped, through-air dried tissue web or an uncreped through-air dried web.

Fifteenth embodiment: The tissue product of the any one of the first through fourteenth embodiments wherein the product comprises 30 wt % or less long, low-coarseness fiber.

Sixteenth embodiment: A single-ply wet-pressed tissue product comprising a first and a second outer layer and a middle layer disposed there between, wherein the first and the second outer layers comprise from about 5 to about 20 wt % long, high-coarseness fiber having an average fiber length greater than about 2.0 mm and a coarseness of 20 mg/100 m or greater, the product having a sheet bulk greater than about 7.0 cc/g, GMT from about 600 to about 1,000 g/3" and a TS7 value less than about 18.0 dB $V^2$ rms.

Seventeenth embodiment: The tissue product of the sixteenth embodiment wherein the center layer is substantially free from long, high-coarseness fiber.

Eighteenth embodiment: The tissue product of the sixteenth or seventeenth embodiments wherein the long, high-coarseness fiber is derived from *P. taeda, P. elliotti, P. palustris, P. pungens, P. rigida, P. serotina, P. muricata*, or *P. radiata*, and combinations thereof, and the fiber has an average fiber length from about 2.0 to about 3.0 mm.

Nineteenth embodiment: The tissue product of the any one of the sixteenth through eighteenth embodiments having a GMT from about 700 to about 1,000 g/3" and a stiffness index from about 20.0 to about 24.0

What is claimed is:

1. A tissue product comprising at least one multi-layered tissue web having a first and a second outer layer and a middle layer disposed there between, wherein the first and the second outer layers comprise from about 5 to about 20 weight percent (wt %) long, high-coarseness wood pulp fiber having an average fiber length greater than about 2.0 mm and a coarseness of 20 mg/100 m or greater, the tissue product having a geometric mean tensile (GMT) from about 700 to about 1,200 g/3" and a TS7 value less than about 12.0 dB $V^2$ rms.

2. The tissue product of claim 1 wherein the middle layer is substantially free from long, high-coarseness wood pulp fiber having an average fiber length greater than about 2.0 mm and a coarseness of 20 mg/100 m or greater.

3. The tissue product of claim 1 wherein the long, high-coarseness wood pulp fiber is derived from *P. taeda, P. elliotti, P. palustris, P. pungens, P. rigida, P. serotina, P. muricata* or *P. radiata,* and combinations thereof.

4. The tissue product of claim 1 wherein the long, high-coarseness wood pulp fiber has an average fiber length from about 2.0 to about 3.0 mm.

5. The tissue product of claim 1 having a GMT from about 700 to about 1,000 g/3" and a stiffness index from about 5.0 to about 8.0.

6. The tissue product of claim 1 having a GMT from about 700 to about 1,000 g/3" and a durability index greater than about 3.75.

7. The tissue product of claim 1 having a GM Tear from about 10.0 to about 15.0 gf.

8. The tissue product of claim 1 having a GM TEA from about 9.0 to about 13.0 g*cm/$cm^2$.

9. The tissue product of claim 1 having Wet Burst of about 100 gf or greater.

10. The tissue product of claim 1 wherein the tissue product comprises from about 50 to about 70 wt % short, low-coarseness wood pulp fiber having an average fiber length less than 1.2 mm and a coarseness less than 20 mg/100 m.

11. The tissue product of claim 10 wherein the short, low-coarseness wood pulp fiber is a hardwood kraft pulp fiber derived from Acacia, Eucalyptus, Maple, Oak, Aspen, Birch, Cottonwood, Alder, Ash, Cherry, Elm, Hickory, Poplar, Gum, Walnut, Locust, Sycamore or Beech.

12. The tissue product of claim 1 wherein the long, high-coarseness wood pulp fiber has a ratio of average fiber length, having units of mm, to coarseness, having units of mg/100 m, of about 0.12 or less.

13. The tissue product of claim 12 having a TS7 value from about 10.0 to about 12.0 dB $V^2$ rms.

* * * * *